United States Patent [19]

Goodnow

[11] Patent Number: 4,889,035

[45] Date of Patent: Dec. 26, 1989

[54] MAGNETICALLY ACTUATED VALVE FOR CYCLICALLY OPERATING PISTON-CYLINDER ACTUATOR

[75] Inventor: Ronald F. Goodnow, Leicester, Mass.

[73] Assignee: Thermo Electron Web Systems, Inc.

[21] Appl. No.: 755,618

[22] Filed: Jul. 16, 1985

[51] Int. Cl.[4] ..... F01L 25/08

[52] U.S. Cl. ..... 91/275; 91/341 R; 91/DIG. 4

[58] Field of Search ..... 91/275, 341 R, 350, 91/410, 361, 459, DIG. 4

[56] References Cited

U.S. PATENT DOCUMENTS

| | | | |
|---|---|---|---|
| 1,032,689 | 7/1912 | Martens | 91/350 X |
| 1,264,168 | 4/1918 | Elvin et al. | 91/410 X |
| 2,597,443 | 5/1952 | Broughton | 91/350 X |
| 2,603,191 | 7/1952 | Sterrett | 91/341 R X |
| 2,930,360 | 3/1960 | Yando | 91/DIG. 4 X |
| 2,960,971 | 11/1960 | Tear | 91/DIG. 4 X |
| 3,700,360 | 10/1972 | Shaddock | 91/275 X |
| 4,325,285 | 4/1982 | Roser | 91/341 R |
| 4,509,402 | 4/1985 | Salmonson | 91/341 R X |

FOREIGN PATENT DOCUMENTS

| | | | |
|---|---|---|---|
| 2247397 | 4/1973 | Fed. Rep. of Germany | 91/DIG. 4 |
| 57-195907 | 12/1982 | Japan | 91/DIG. 4 |
| 889149 | 2/1962 | United Kingdom | 91/459 |

*Primary Examiner*—Robert E. Garrett
*Assistant Examiner*—George Kapsalas
*Attorney, Agent, or Firm*—Samuels, Gauthier, Stevens & Kehoe

[57] ABSTRACT

A fluid pressure oscillator is provided with a cylinder containing a piston assembly. Fluid actuated reciprocation of the piston assembly is controlled by a valve mounted externally of the cylinder. The valve is alternately shifted between "advance" and "retract" settings by a reciprocating actuating rod removably received in the cylinder. A magnet on the piston assembly cooperates with magnetic elements on the actuating rod to automatically reciprocate the latter.

5 Claims, 2 Drawing Sheets

MAGNETICALLY ACTUATED VALVE FOR CYCLICALLY OPERATING PISTON-CYLINDER ACTUATOR

BACKGROUND OF THE INVENTION

1. Field of the Invention

This invention relates generally to fluid pressure oscillators of the type employed to reciprocate various mechanical devices, and is concerned in particular to an improved arrangement for controlling the operation of such oscillators.

2. Description of the Prior Art

A typical fluid pressure oscillator is disclosed in U.S. Pat. No. 2,987,051 (Goyette et al). Here, the reciprocating movement of the piston assembly is controlled by a relatively complicated valve assembly located inside the cylinder. In order to gain access to the valve assembly when performing repair and/or routine maintenance, the actuator must be almost entirely dismantled and thereafter reassembled.

Such procedures are extremely time consuming, and difficult to perform satisfactorily while the oscillators remain mounted in their "on line" operative position on production machinery. Consequently, when repairs or maintenance are required, the oscillators are normally entirely replaced by spare oscillators that are either new or that have been subjected to "off line" repairs and/or reconditioning. Oscillators are relatively expensive components and therefore the need to maintain an inventory of spares significantly increases overall production costs.

SUMMARY OF THE INVENTION

A primary objective of the present invention is to provide a fluid pressure oscillator with a valve arrangement which is readily accessible and replaceable when the need arises, without having to replace the entire oscillator.

A companion object of the present invention is the provision of an improved valve arrangement which is simpler in design and more reliable in operation than those employed heretofore in prior art arrangements.

These and other objects and advantages of the present invention will be described hereinafter in greater detail in connection with a preferred embodiment wherein a fluid pressure oscillator is provided with a cylinder containing a piston assembly. Fluid actuated reciprocation of the piston assembly is controlled by a valve mounted externally of the cylinder. The valve is alternately shifted between "advance" and "retract" settings by a reciprocating actuating rod removably received in the cylinder. A magnet on the piston assembly cooperates with magnetic elements on the actuating rod to automatically reciprocate the latter.

The novel features which are considered as characteristic of the present invention are set forth in particular in the appended claims. The invention itself, however, both as to its construction and operation, together with additional objects and advantages thereof, will best be understood from the following description of a preferred embodiment when read in connection with the accompanying drawings.

DETAILED DESCRIPTION OF DISCLOSED EMBODIMENT

Figure 1:
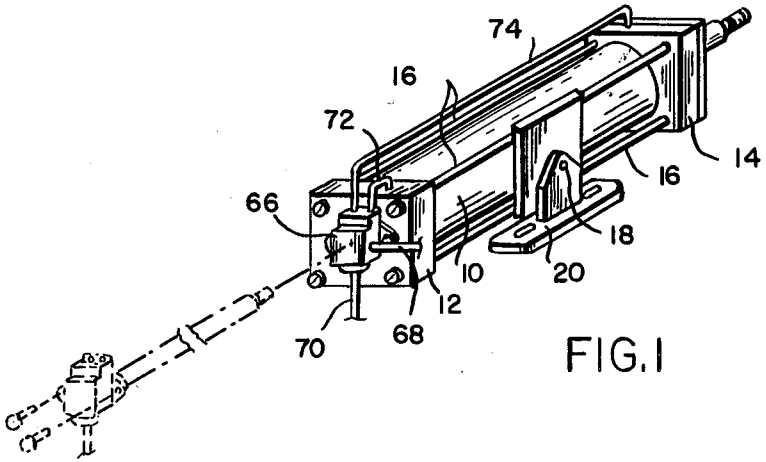
FIG. 1 is a perspective view of a fluid pressure oscillator in accordance with the present invention.
Figure 2:
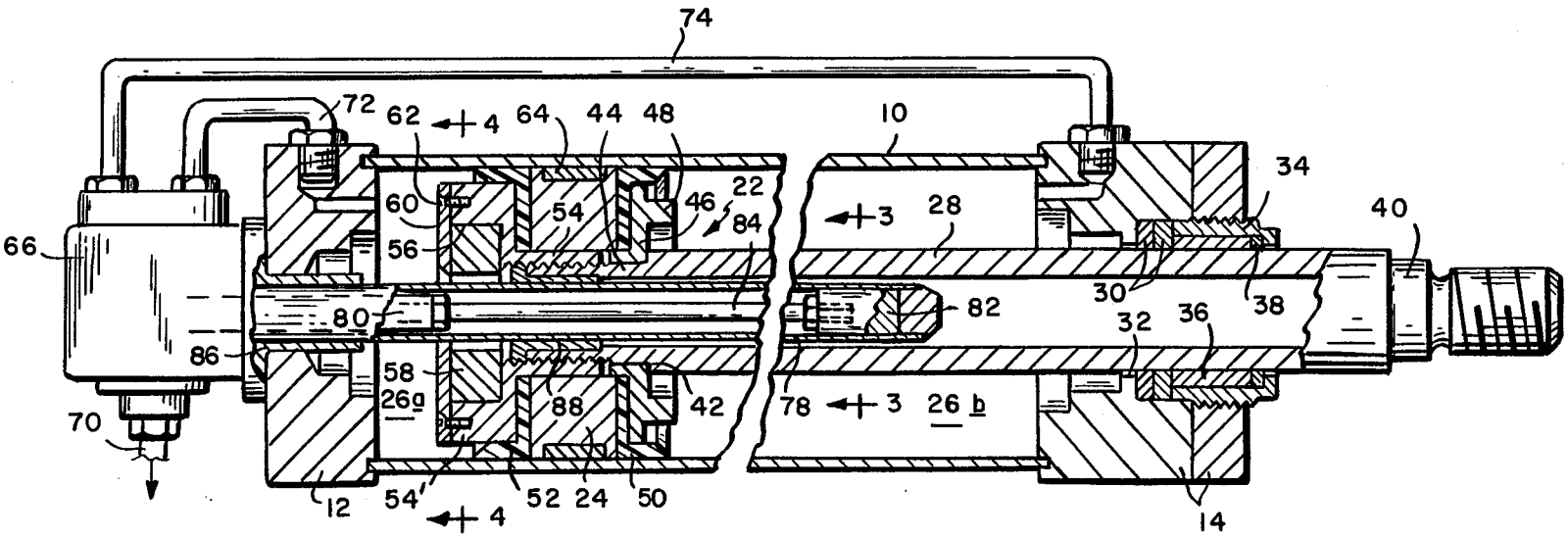
FIG. 2 is a longitudinal sectional view on a greatly enlarged scale taken through the fluid pressure oscillator shown in FIG. 1.
Figure 3:
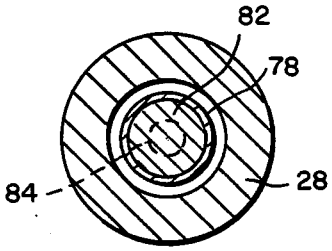
FIGS. 3 and 4 are additionally enlarged sectional views taken respectively along lines 3—3 and 4—4 of FIG. 2.
Figure 4:
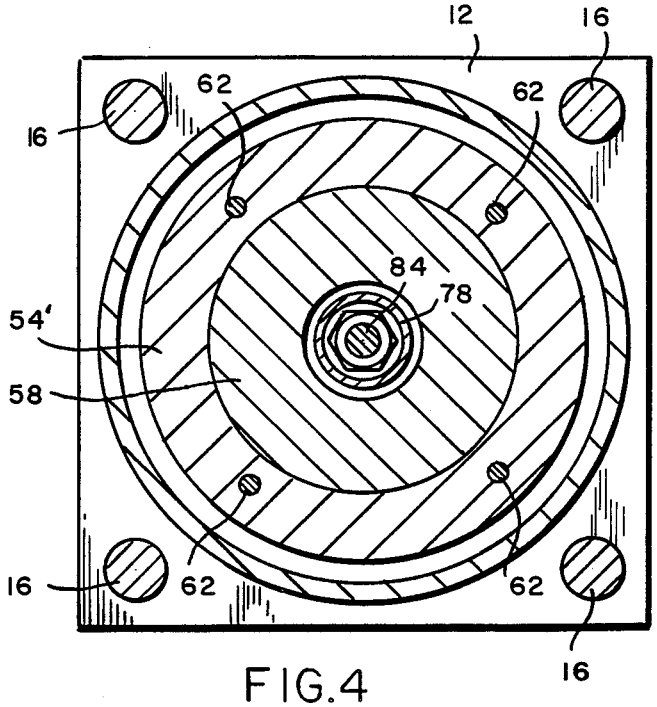

Referring initially to FIGS. 1-4 of the drawings, a fluid pressure oscillator in accordance with the present invention is shown comprising a cylinder 10 having its opposite ends closed by end caps 12 and 14. The end caps are held together by tie bolts 16 extending externally of the cylinder, and the cylinder is pivotably supported as at 18 on a pair of brackets 20, only one of which is shown in FIG. 1.

A piston assembly 22 is mounted in the cylinder 10. The piston assembly includes an annular piston 24 which subdivides the cylinder into chambers **26*a* and 26*b*. A tubular piston rod 28 protrudes axially from the piston through an opening in the end cap 14. Sealing rings 30 encircle the piston rod. The sealing rings are held in place against an interior circular shoulder 32 by means of a bushing 34 threaded into the end cap 14. The bushing 34 contains a sleeve bearing 36 and an additional ring seal 38**.

The protruding end of the piston rod 28 is closed by an externally threaded end plug 40. At its opposite end, the piston rod has a shoulder 42 leading to a reduced diameter portion 44 which is threaded externally at its outermost end. A collar 46 is received on the reduced diameter portion 44 against the shoulder 42. One side of collar 46 has an integral circular nose 48 protruding axially therefrom, and the opposite side of the collar locates a circular piston seal 50. The piston 24 is mounted between the seal 50 and a second mirror image seal 52. A sleeve 54 with an enlarged diameter annular head portion 54' is threaded onto the piston rod to hold the collar 46, piston 24 and seals 50, 52 in place.

The head portion 54' defines a circular cavity 56 containing an annular permanent magnet 58. The magnet is held in the cavity 56 by a retainer plate 60 secured to the head portion 54' by any convenient means such as machine screws 62. The piston 24 is externally grooved to contain a slide bearing 64 in contact with the interior surface of the cylinder 10.

A control valve 66 is removably mounted on the end cap 12. The control valve is adapted for connection to a fluid pressure feed line 68 leading from a pump or other like source of pressurized fluid (not shown), and to a return or drain line 70. The control valve 66 is additionally connected by conduits 72, 74 leading respectively to the cylinder chambers **26*a*, 26*b***.

Figure 5A:
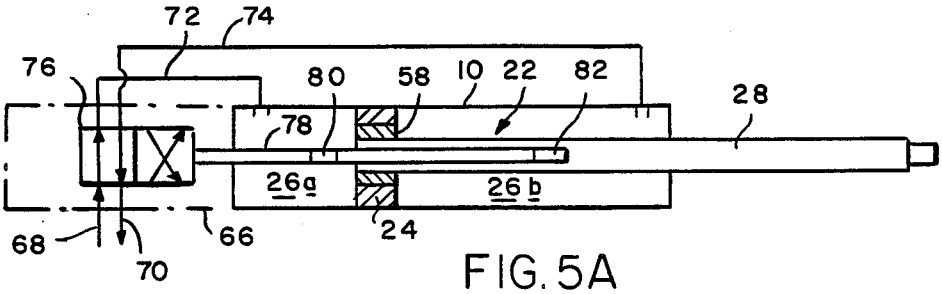
FIGS. 5A and 5B are schematic illustrations showing the valve assembly adjusted respectively to its "advance" and "retract" settings.
Figure 5B:
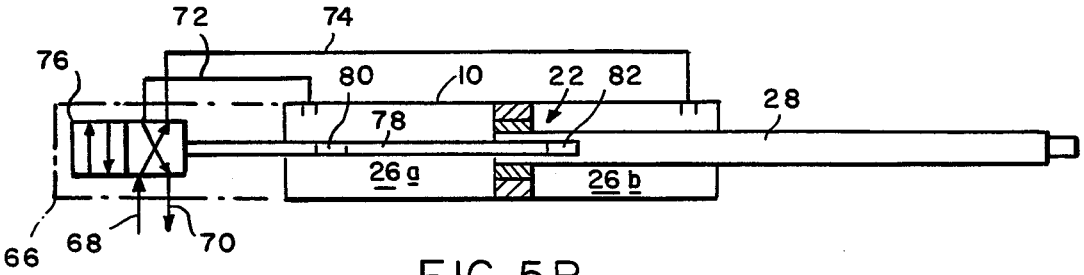

The control valve is of the conventional 4-way type having an internal spool 76 adapted to be shuttled to and fro between an "advance" setting as shown in FIG. 5A and a "retract" setting as shown in FIG. 5B. When in the advance setting, the spool passages respectively connect the pressure and return lines 68, 70 to the cylinder chambers **26*a*, 26*b* via conduits 72, 74, causing the piston assembly 22 to be advanced to the right. When in the retract setting, the spool achieves the opposite result, i.e., the pressure and return lines 68, 70 are connected via conduits 74, 72 to the chambers 26*b*, 26*a***, causing the piston assembly to be retracted in the opposite direction.

The spool 76 is shuttled to and fro by a tubular actuating rod 78 which protrudes from the valve 66 axially through the end cap 12 and the magnet 58 into the piston rod 28. The actuating rod contains axially spaced magnetic elements 80, 82 interconnected by an internal rod 84. The actuating rod 78 is guided for slidable movement in relation to the cylinder end cap 12 by a bushing 86, and for slidable movement relative to the piston assembly 22 by means of a second bushing 88 inserted into the end of piston rod 28.

With the exception of the magnet 58 and the magnetic elements 80, 82, the remainder of the metallic components are made from non-magnetic metals such as brass and chrome plated stainless steel. The various seals and guide bushings are typically non-metallic, e.g., thermoplastic or rubber. The magnetic elements can, for example, be made from 430F stainless steel.

The oscillator operates in the following manner: when the control valve spool 76 is set as shown in FIG. 5A, pressurized fluid advances the piston assembly 22 to the right until such time as the attractive force of magnet 58 pulls the magnetic element 82 of actuating rod 78 to the left. This causes the spool 76 to be shunted to the position shown in FIG. 5B, with the result that the piston assembly 22 is now retracted to the left. This motion will continue until the attractive force of the magnet 58 acts on magnetic element 80 to shunt the actuating rod 78 and spool 76 back to the advance setting shown in FIG. 5A. In other words, each time the actuating rod 78 and spool 76 are shunted in one direction by the attractive force of the magnet 58 acting on one or the other of the elements 80, 82, the piston assembly 22 is reciprocated in the opposite direction. This reciprocating action will continue as long as pressurized fluid is being fed to the control valve 66.

In light of the foregoing, it will now be appreciated by those skilled in the art that the present invention embodies a number of novel and advantageous features. For example, the control valve 66 is arranged entirely externally of the cylinder 10. When repair or replacement of the control valve is required, one need only disconnect the pressure and return lines 68, 70 and the connecting conduits 72, 74. Thereafter, as shown by the phantom lines in FIG. 1. The control valve along with the actuating rod 78 can be pulled from the cylinder, without disturbing the piston assembly 22. A fresh control valve then can be reinstalled by a reverse procedure. This can be accomplished quickly, while the oscillator remains installed in an "on line" operative position.

The means for controlling the reciprocation of the actuating rod 78, and hence the reciprocation of the piston assembly 22 is relatively simple and trouble free. It basically entails a single permanent magnet 58 riding with the piston assembly, and a pair of axially spaced magnetic elements 80, 82 on the actuating rod 78. The entire assembly is thus easy to maintain, and relatively inexpensive as compared to prior art arrangements involving internal complicated valve arrangements.

I claim:

1. A magnetically actuated fluid pressure oscillator comprising:

a cylinder;

a piston assembly including a piston contained within and sub-dividing the interior of said cylinder into first and second chambers, with a piston rod and protruding from said piston through one end of said cylinder;

a control valve mounted externally of said cylinder and adapted for connection to fluid and return lines, said control valve being connected by conduit means to said first and second cylinder chambers and having an actuating rod shiftable in opposite directions relative to both said cylinder and said piston assembly to adjust said valve between an advance setting at which said fluid pressure and return lines are connected respectively to said first and second chambers, and a retract setting at which said fluid pressure and return lines are connected respectively to said second and first chambers, thereby controlling the flow of pressure fluid to and from said chambers in a manner causing said piston assembly to reciprocate relative to said cylinder;

mutually spaced magnetic elements carried by said actuating rod; and a magnet carried by said piston assembly for reciprocating movement therewith, said valve being alternately adjustable from one to the other of said advance and retract settings by the magnetic force of said magnet acting on said magnetic elements to shift said actuating rod in opposite directions.

2. The fluid pressure oscillator of claim 1 wherein said control valve is detachably secured to an end of said cylinder which is opposite to the said one end, and wherein said actuating rod protrudes through said opposite end and is removably received in said cylinder.

3. The fluid pressure oscillator of claim 2 wherein said actuating rod extends axially through said magnet into said piston rod.

4. The fluid pressure oscillator of claim 1 wherein a passageway extends axially through said piston, said magnet and said piston rod, and wherein said actuating rod is axially received in said passageway.

5. The fluid pressure oscillator of claim 1 wherein said control valve and said actuating rod are removable as a unit from said cylinder in a manner permitting said piston assembly to remain undisturbed.

* * * * *